US012285060B2

(12) United States Patent
Ichigaya

(10) Patent No.: US 12,285,060 B2
(45) Date of Patent: Apr. 29, 2025

(54) GARMENT BODY FOR FAN-EQUIPPED GARMENT, AND FAN-EQUIPPED GARMENT

(71) Applicant: SFT LABORATORY CO., LTD., Tokyo (JP)

(72) Inventor: Hiroshi Ichigaya, Tokyo (JP)

(73) Assignee: SFT LABORATORY CO., LTD., Tokyo (JP)

( * ) Notice: Subject to any disclaimer, the term of this patent is extended or adjusted under 35 U.S.C. 154(b) by 0 days.

(21) Appl. No.: 17/916,538

(22) PCT Filed: Apr. 1, 2021

(86) PCT No.: PCT/JP2021/014137

§ 371 (c)(1),
(2) Date: Sep. 30, 2022

(87) PCT Pub. No.: WO2021/201212

PCT Pub. Date: Oct. 7, 2021

(65) Prior Publication Data

US 2023/0148688 A1 May 18, 2023

(30) Foreign Application Priority Data

Apr. 1, 2020 (JP) ..... 2020-065463

(51) Int. Cl.
*A41D 13/002* (2006.01)

(52) U.S. Cl.
CPC ..... *A41D 13/0025* (2013.01)

(58) Field of Classification Search
CPC ..... A41D 13/002; A41D 13/0025; A41D 13/105; A41D 3/02; A41D 2200/20
See application file for complete search history.

(56) References Cited

U.S. PATENT DOCUMENTS

| | | | | |
|---|---|---|---|---|
| 5,704,064 | A | 1/1998 | van der Sleesen | |
| 9,732,449 | B2 * | 8/2017 | Takayanagi | D03D 15/54 |
| 11,832,660 | B2 * | 12/2023 | Tokunaga | A41D 13/002 |
| 2007/0271939 | A1 | 11/2007 | Ichigaya | |
| 2009/0271917 | A1 * | 11/2009 | Richardson | A41D 13/0025 2/458 |

(Continued)

FOREIGN PATENT DOCUMENTS

| | | | |
|---|---|---|---|
| CN | 2070999 | U | 2/1991 |
| CN | 103481554 | A | 1/2014 |

(Continued)

OTHER PUBLICATIONS

International Preliminary Report on Patentability (IPRP) (and English language translation thereof) dated Sep. 29, 2022, issued in International Application No. PCT/JP2021/014137.

(Continued)

*Primary Examiner* — Katherine M Moran
(74) *Attorney, Agent, or Firm* — Holtz, Holtz & Volek PC

(57) ABSTRACT

A garment body of a fan-equipped garment includes a fan mount hole for mounting a fan, a front fabric made of a material having no breathability or having a certain level of breathability to be inflated with air introduced by the fan, and a heat insulation layer disposed on a back side of the front fabric and made of a material that holds air.

14 Claims, 9 Drawing Sheets

(56) References Cited

U.S. PATENT DOCUMENTS

| | | | | |
|---|---|---|---|---|
| 2013/0178146 | A1* | 7/2013 | Stockett | A41D 31/102 454/339 |
| 2019/0166928 | A1* | 6/2019 | Miwa | F04D 17/16 |
| 2023/0404184 | A1* | 12/2023 | Matsui | F24F 1/04 |
| 2024/0049811 | A1* | 2/2024 | Nakatsugawa | A41D 13/005 |

FOREIGN PATENT DOCUMENTS

| | | | | |
|---|---|---|---|---|
| JP | S4431186 | B1 | 12/1969 | |
| JP | H10513233 | A | 12/1998 | |
| JP | 2000045113 | A | 2/2000 | |
| JP | WO03103424 | A1 * | 6/2002 | A41D 13/00 |
| JP | 2005154970 | A | 6/2005 | |
| JP | 2006132040 | A | 5/2006 | |
| JP | 5840271 | B1 | 11/2015 | |
| JP | 2017101354 | A | 6/2017 | |
| JP | 2018141256 | A | 9/2018 | |
| JP | 3221004 | U | 3/2019 | |
| JP | 2019119939 | A | 7/2019 | |
| JP | 3225346 | U | 2/2020 | |
| WO | 2005063065 | A1 | 7/2005 | |

OTHER PUBLICATIONS

International Search Report (ISR) (and English translation thereof) dated Jun. 22, 2021, issued in International Application No. PCT/JP2021/014137.

Written Opinion dated Jun. 22, 2021, issued in International Application No. PCT/JP2021/014137.

Chinese Office Action (and an English language translation thereof) dated Feb. 22, 2025, issued in counterpart Chinese Application No. 202180025411.4.

* cited by examiner

GARMENT BODY FOR FAN-EQUIPPED GARMENT, AND FAN-EQUIPPED GARMENT

TECHNICAL FIELD

The present invention relates to a garment body of a fan-equipped garment and the fan-equipped garment.

BACKGROUND

In recent years, a fan-equipped garment for cooling the body has been put to practical use and rapidly spread (for example, see Patent Document 1).

Owing to the effects of global warming in recent years, the air temperature is higher than the body surface temperature in many days. Therefore, a material of the fan-equipped garment is required to have high heat-insulating properties so as not to conduct the outside air temperature to the inside of the garment. The fan-equipped garment, which is often used outdoor, is also required to have a high sunlight blocking effect.

In response to such needs, a known fan-equipped garment is given a high sunlight blocking effect by sputtering titanium on the back side of the polyester fabric (for example, see Patent Document 2).

CITATION LIST

Patent Document

[Patent Document 1] WO2005-063065A1
[Patent Document 2] JP2005-154970A

SUMMARY

Technical Problem

However, the titanium sputtering is only applicable to the polyester woven fabric. The titanium sputtering also costs much, and its sunlight blocking effect does not last long because the thin film is worn away by being rubbed against the underwear with use. Further, when the outside air temperature is higher than the skin temperature, the titanium sputtering yields only a small heat-insulating effect of preventing the intrusion of heat of the outside air temperature.

An object of the present invention is to provide a garment body of a fan-equipped garment and the fan-equipped garment, the garment body having a high heat-insulation effect and being able to block the sunlight, thereby effectively functioning as the garment body of the fan-equipped garment.

Solution to Problem

According to a first aspect of the present invention, a garment body of a fan-equipped garment: includes: a fan mount hole for mounting a fan; a front fabric made of a material having no breathability or having a certain level of breathability to be inflated with air introduced by the fan; and a heat insulation layer disposed on a back side of the front fabric and made of a material that holds air.

According to a second aspect of the invention, the garment body further includes: a collar air-discharge part between a neck of a wearer and an end of a collar of the garment body, the collar air-discharge part discharging air that is introduced inside the garment body through the fan mount hole; and a collar air-discharge part adjuster that is configured to adjust an air discharge pressure at the collar air-discharge part.

According to a third aspect of the invention, the garment body has a long sleeve, and the garment body further includes: a sleeve air-discharge part between an arm of a wearer and an end of the sleeve, the sleeve air-discharge part discharging air that is introduced inside the garment body through the fan mount hole; and a sleeve air-discharge part adjuster that is configured to adjust an air discharge pressure at the sleeve air-discharge part.

According to a fourth aspect of the invention, the sleeve air-discharge part adjuster is a rib part and is freely attachable to and detachable from a part of the sleeve facing a wrist.

According to a fifth aspect of the invention, the garment body further includes a sealing part that seals the sleeve air-discharge part.

According to a sixth aspect of the invention, the sleeve air-discharge part adjuster is configured to adjust a circumference length of the sleeve air-discharge part to 130% or greater of a minimum circumference length.

According to a seventh aspect of the invention, the garment body further includes a hood that is configured to cover a neck and a head of the wearer, wherein an air-discharge part adjuster for adjusting an air discharge pressure between the head and the hood is attachable to an inner surface of the hood.

According to an eighth aspect of the invention, a fan mount hole cover for covering the fan mount hole is housed inside the garment body.

According to a ninth aspect of the invention, the garment body is a coat type configured to cover a trunk, arms, and part of legs of a wearer, and an air-leakage preventer is formed at a waist part inside the garment body.

According to a tenth aspect of the invention, the garment body further includes a back fabric disposed on a back side of the heat insulation layer.

According to an eleventh aspect of the invention, the front fabric is made of a material that has a higher sunlight reflectivity than the back fabric, and the back fabric is made of a material that has a higher sunlight absorbency than the front fabric and the heat insulation layer.

According to a twelfth aspect of the invention, a color of the back fabric is darker than a color of the front fabric.

According to a thirteenth aspect of the invention, the fan mount hole has a substantially rectangular shape.

According to a fourteenth aspect of the invention, the front fabric, the heat insulation layer, and the back fabric are combined with stitches, and the fan mount hole is formed in an area surrounded by the stitches.

According to a fifteenth aspect of the invention, a fan-equipped garment includes the garment body of one of the first to fourteenth aspects, an air introducer that introduces air inside the garment body, and a power source that supplies electric power to the air introducer.

Advantageous Effects of Invention

The present invention can provide a garment body of a fan-equipped garment and the fan-equipped garment, the garment body having a high heat-insulation effect and being able to block the sunlight and thereby effectively functioning as the garment body of the fan-equipped garment.

DESCRIPTION OF EMBODIMENTS

First Embodiment

Hereinafter, a first embodiment of the garment body of the fan-equipped garment according to the present invention is described in detail with reference to FIG. 1 to FIG. 3. The embodiments described below are provided with various limitations technically preferable for carrying out the present invention. However, the scope of the present invention is not limited to the embodiments below or illustrated examples.

In the description below, the front side of the wearer is front; the back side of the wearer is back; the upper side of the wearer is up; the lower side of the wearer is down; the right-hand side of the wearer is right; and the left-hand side of the wearer is left, based on the state of the fan-equipped garment 100 worn by a wearer.

[Fan-Equipped Garment]

Figure 1:
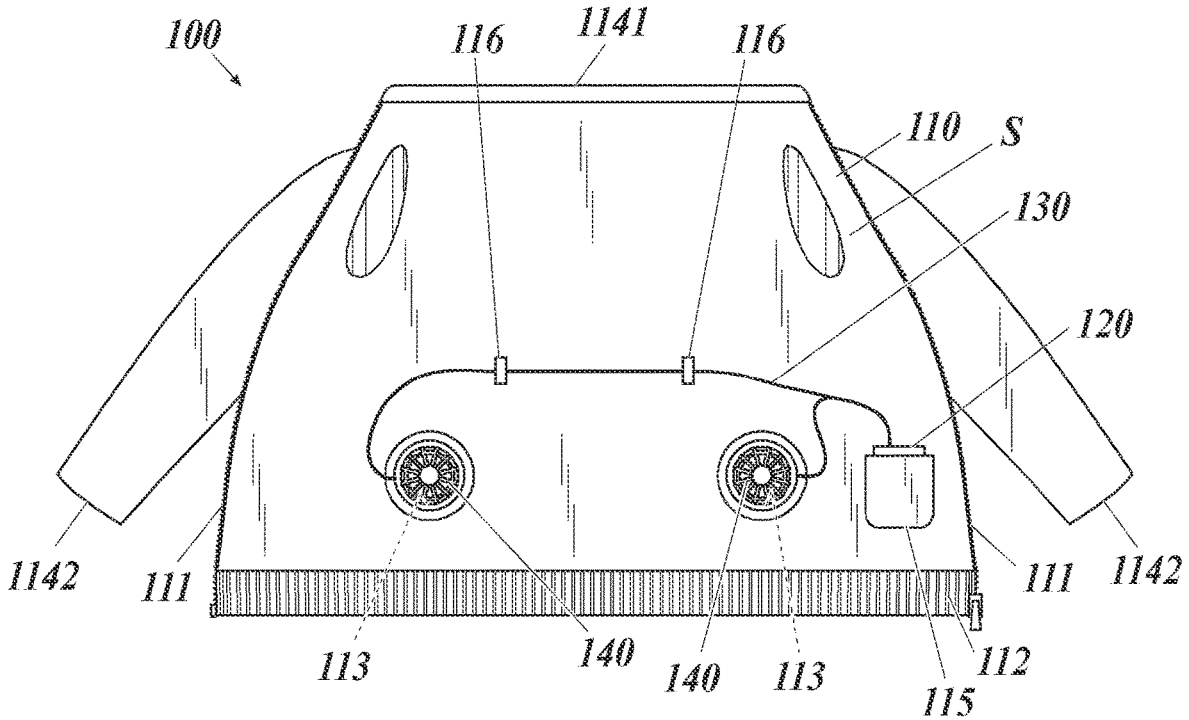
FIG. 1 is a front view of a fan-equipped garment in a first embodiment, wherein an opening-closing tool on the front part is open.

As shown in FIG. 1, the fan-equipped garment 100 includes a garment body 110; fans 140 that introduce air inside the garment body 110; a power source 120 that supplies the fans 140 with electric power; and a connection cable 130 that connects the power source 120 to the fans 140. The fan-equipped garment 100 introduces air into the garment body 110 with the fans 140, flows the introduced air along the body surface of the wearer or along the surface of the underwear, so that the sweat drained from the body evaporates. The body is cooled by the evaporation heat generated in evaporation of the sweat.

[Garment Body]

A blouson-type garment body 110 is described as an example. As shown in FIG. 1, the garment body 110 is formed to cover at least the trunk of the wearer and is formed with a sheet member S having no breathability or having a certain level of breathability that allows the garment body 110 to be inflated with air introduced by the fans 140. Although the garment body 110 in FIG. 1 is a blouson type that covers the trunk and arms of the wearer, the shape of the garment body 110 is not limited to this. For example, the garment body 110 can be formed as overalls that are an upper garment and a lower garment connected as one-piece; a vest that covers only the trunk; and a coat that covers the trunk, the arms, and part of the legs of the wearer. The garment body 110 of the present invention is therefore not limited to a blouson type.

The garment body 110 refers to part of the fan-equipped garment 100 except electric components, such as the power source 120, the connection cable 130, and the fans 140. The garment body 110 is the part of the fan-equipped garment 100 that serves as a garment. The garment cloth is part of the sheet member S constituting the garment, the part covering the body of the wearer and determining the shape of the garment. The garment cloth does not include auxiliary parts that do not affect the shape of the garment (e.g., the sheet member S used for a pocket).

The surface that faces the wearer when the wearer wears the garment body 110 is called the back surface, and the opposite surface that faces the external space when the wearer wears the garment body 110 is called the front surface. The back surface of the garment cloth and a part closer to the wearer than the back surface of the garment cloth when the wearer wears the garment body 110 is called the back surface side of the garment body 110. The front surface of the garment cloth and a part closer to the external space than the front surface of the garment cloth when the wearer wears the garment body 110 is called the front surface side of the garment body 110.

The garment body 110 includes an opening-closing tool 111, an air-leakage preventer 112, fan mount holes 113, air-discharge parts 114, a power source holder 115, and a cable holder 116.

Figure 2A:
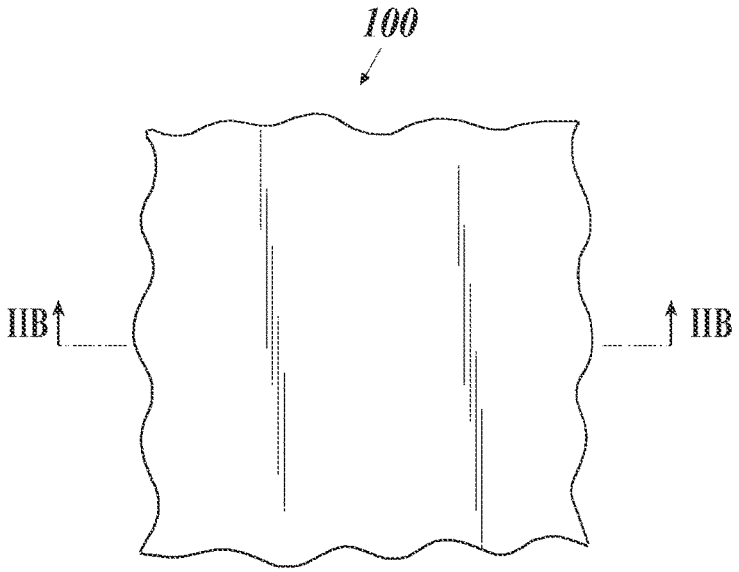
FIG. 2A is an enlarged view of the fan-equipped garment in the first embodiment.
Figure 2B:
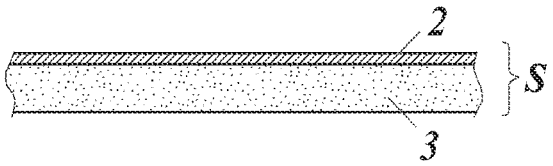
FIG. 2B is a cross section along the IIB-IIB part in FIG. 2A.

FIG. 2A is an enlarged planar view of the fan-equipped garment 100 in the first embodiment. FIG. 2B is a cross section along the IIB-IIB in FIG. 2A. As shown in FIG. 2B, the fan-equipped garment 100 in the first embodiment is formed with the sheet member S that includes a front fabric 2 and a heat insulation layer 3.

(Front Fabric)

The front fabric 2 constitutes the front surface side of the fan-equipped garment 100. The front fabric 2 is mainly formed of a finely woven fabric.

The front fabric 2 is made of polyester, polyester and cotton blended fabric, or nylon, for example, but is not limited to them as long as the front fabric 2 has low air permeability. The sunlight blocking factor can also be taken into account.

(Heat Insulation Layer)

The heat insulation layer 3 is a fabric fixed to the back surface side of the front fabric 2. The heat insulation layer 3 is made of a material that can keep air inside.

In this embodiment, it is preferable that fleece made of polyethylene terephthalate be used. As described later, when the heat insulation layer 3 is the intermediate layer of a three-layer structure, the following may be used as desired: feathers (e.g., down); synthetic fiber cotton or sponge made of nylon, polyester, or the like; and natural cotton, for example.

When the heat insulation layer 3 is made of sponge, it is preferable that the sponge have the expansion ratio equal to or greater than 80% and the thickness equal to or greater than 5 millimeters. When the heat insulation layer 3 is made of down, it is preferable that the down hold air equal to or greater than 3 liters/m2.

Practical Examples

Hereinafter, the evaluation result of preferable structures for heat insulating effects is explained on the basis of practical examples of the present invention and comparative examples. Although the present invention is described in detail below on the basis of the practical examples, the present invention is not limited to the examples.

[Structures of Practical Examples and Comparative Examples]

The following were prepared: practical examples 1 to 4 as samples having the heat insulation layer 3; a comparative example 1 without a sample (direct irradiation); and a comparative example 2 as a sample that consists of only a fabric and that does not have the heat insulation layer 3. Each of the samples of the practical examples 1 to 4 is a square-floor-cushion-like bag body formed of 1000 polyester fabrics between which the heat insulation layer 3 is disposed. Each of the fabrics forming the bag body is approximately 0.1 millimeter thick and approximately 400 millimeters on a side. The heat insulation layer 3 disposed inside the practical examples 1, 2 is down, and the heat insulation layer 3 disposed inside the practical examples 3 and 4 is padding, as described below. In order to compare down and padding, the thicknesses of the heat insulation layers 3 made of down and padding in the bag bodies were made substantially equal between the practical examples 1 and 3, and between the practical examples 2 and 4, respectively.

Practical Example 1

To form the heat insulation layer 3, the down consisting of 80% down and 20% feathers was disposed in the bag body with 670 fill power such that the thickness of the heat insulation layer 3 is approximately 13.0 millimeters.

Practical Example 2

To form the heat insulation layer 3, the down consisting of 80% down and 20% feathers was disposed in the bag body with 670 fill power such that the thickness of the heat insulation layer 3 is approximately 33.5 millimeters.

Practical Example 3

To form the heat insulation layer 3, two sheets of padding made of 100% polyester and 6.5 millimeters thick (KNF-350 manufactured by Japan Vilene Company, Ltd.) were layered and disposed in the bag body. In this practical example 3, the thickness of the polyester padding as the heat insulation layer 3 is approximately 13.0 millimeters.

Practical Example 4

To form the heat insulation layer 3, a sheet of padding made of 100% polyester and 16.5 millimeters thick (KNF-950 manufactured by Japan Vilene Company, Ltd.), a sheet of padding made of 100% polyester and 10.5 millimeters thick (KNF-650 manufactured by Japan Vilene Company, Ltd.), and a sheet of padding made of 100% polyester and 6.5 millimeters thick (KNF-350 manufactured by Japan Vilene Company, Ltd.) were layered and disposed in the bag body. In this practical example 4, the thickness of the polyester padding as the heat insulation layer 3 is approximately 33.5 millimeters.

Comparative Example 1

In this example, an artificial solar lighting directly irradiated a sensor without a sample inbetween (direct irradiation).

Comparative Example 2

Only the fabric that constitutes the bag body in the practical examples 1 to 4 (100% polyester square fabric approximately 400 millimeters on a side and approximately 0.1 millimeter thick) was prepared as the sample.

[Experimentation Details]

An artificial solar lighting (XC-100E manufactured by SERIC LTD.) was placed at a position one meter away from the position where the samples of the practical examples and the comparative examples were set. Below each of the samples, a piece of expanded polystyrene was placed at the side opposite the setting position of the artificial solar lighting with the sample inbetween. Only the surface facing the artificial solar lighting of the expanded polystyrene was open, and the open surface was covered with the sample, so that the piece of expanded polystyrene formed a space having a predetermined volume (approximately 5,600 $cm^3$ (length: approximately 25 centimeters, width: approximately 16 centimeters, height: approximately 14 centimeters)). Thus, the state inside the garment body 110 being worn was simulated. Temperature changes in such structures were measured when the samples were irradiated for 10 minutes, 20 minutes, and 30 minutes by the artificial solar lighting. The sensors were covered with black cloths in order to easily grasp the temperature changes.

TABLE I shows the measurement results in the above experimentation.

TABLE I

| | START | 10 min. LATER | 20 min. LATER | 30 min. LATER | TEMPERATURE DIFFERENCE BETWEEN START AND 30 min. LATER |
|---|---|---|---|---|---|
| PRACTICAL EXAMPLE 1 (DOWN, 13.0 mm) | 26.6° C. | 27.0° C. | 27.5° C. | 27.7° C. | +1.1° C. |
| PRACTICAL EXAMPLE 2 (DOWN, 33.5 mm) | 26.3° C. | 26.4° C. | 26.8° C. | 27.1° C. | +0.8° C. |
| PRACTICAL EXAMPLE 3 (PADDING, 13.0 mm) | 26.9° C. | 27.8° C. | 28.5° C. | 28.7° C. | +1.8° C. |
| PRACTICAL EXAMPLE 4 (PADDING, 33.5 mm) | 27.5° C. | 27.7° C. | 28.1° C. | 28.3° C. | +0.8° C. |
| COMPARATIVE EXAMPLE 1 (DIRECT IRRADIATION) | 23.0° C. | 27.5° C. | 28.4° C. | 28.7° C. | +5.7° C. |
| COMPARATIVE EXAMPLE 2 (FABRIC) | 23.1° C. | 25.1° C. | 26.2° C. | 26.7° C. | +3.6° C. |

(Evaluation)

The comparison between the practical examples 1 to 4 and the comparative examples 1, 2 shows that the heat insulation layer 3 yields remarkable heat insulating effects against the sunlight irradiation.

Further, the comparison between the practical examples 1 and 2 and the comparison between the practical examples 3 and 4 show that the thicker heat insulation layer 3 yields greater heat insulating effects.

Further, the comparison between the practical examples 1 and 3 shows that, as the heat insulation layer 3, the down yields greater heat insulating effects than the padding but that the padding also yields sufficient heat insulating effects.

(Opening-Closing Tool)

Referring back to FIG. 1, the opening-closing tool 111 allows the garment body 110 to be front-open and allows the wearer to open and close the front part of the garment body 110 in wearing the fan-equipped garment 100. The specific configuration of the opening-closing tool 111 is determined as desired. For example, a normal linear fastener is used. The opening-closing tool 111 is not limited to a linear fastener as long as the opening-closing tool 111 can freely connect and disconnect the divided front parts of the garment body 110. However, in view of preventing air leakage, a linear fastener is preferable.

(Air-Leakage Preventer)

The air-leakage preventer 112 is provided at the lower part of the garment body 110, as shown in FIG. 1. The air-leakage preventer 112 prevents air in the space between the garment body 110 and the wearer's body from leaking outside through the hem of the garment body 110. The specific configuration of the air-leakage preventer 112 may be determined as desired as long as the air-leakage preventer 112 can prevent air leakage from the lower part of the garment body 110 to the outside. For example, the air-leakage preventer 112 is formed with an elastic material, such as a rubber cord, and provided at the position corresponding to the abdomen of the wearer wearing the garment body 110 around the wearer's body.

When the wearer wears the fan-equipped garment 100, the air-leakage preventer 112 narrows the part of the garment body 110 corresponding to the abdomen of the wearer and closely fits to the wearer's body. Accordingly, the air-leakage preventer 112 prevents the air introduced by the fans 140 from flowing from the space between the garment body 110 and the upper half of the wearer's body to the space between the garment body 110 and the lower half of the wearer's body. Thus, the air-leakage preventer 112 can increase the amount of air discharged from the air-discharge parts 114 and increase the cooling effect for the upper half of the wearer's body.

The air-leakage preventer 112 is not an essential component. For example, when the garment body 110 is the overall type and does not include the air-leakage preventer 112, the air introduced by the fans 140 may also flow from the space between the garment body 110 and the upper half of the wearer's body to the space between the garment body 110 and the lower half of the wearer's body and may be discharged through the hem. In this case, the entire body of the wearer can be thoroughly cooled.

Thus, the air-leakage preventer 112 may not be provided depending on the shape of the garment body 110.

(Fan Mount Holes)

The fan mount holes 113 are provided on the sheet member S constituting the garment body 110 at positions corresponding to the left and right of the waist of the wearer, as shown in FIG. 1. When the wearer wears the fan-equipped garment 100, the fan mount holes 113 connect the space between the garment body 110 and the wearer's body to the outside. The shape of the fan mount holes 113 conforms to the external shape of the fans 140.

The fans 140 are mounted by being inserted in the fan mount holes 113, so that the fans 140 can introduce outside air to the inside of the garment body 110 through the fan mount holes 113.

In view of effectively cooling the wearer wearing the fan-equipped garment 100, it is preferable that the fan mount holes 113 be formed at the above-described positions. However, the positions of the fan mount holes 113 are not limited to the above. For example, the fan mount holes 113 may be formed at positions corresponding to the positions below the armpits of the wearer.

The number of fan mount holes 113 formed is not limited to two. There may be more than or less than two fan mount holes 113 and the fans 140 of the corresponding number.

(Air-Discharge Part)

The air-discharge parts 114 are the openings for discharging the air that has been introduced by the fans 140 through the fan mount holes 113 and flown along the wearer's body or the underwear, as shown in FIG. 1. For example, the air-discharge parts 114 are: a collar air-discharge part 1141 between the neck of the wearer and the collar edge of the garment body 110; and sleeve air-discharge parts 1142 each of which is between the wearer's arm and the sleeve edge of the garment body 110.

The positions where the air-discharge parts 114 are formed are not limited to the collar and sleeves as long as the air-discharge parts 114 can discharge the air that has been introduced into the garment body 110 by the fans 140 and that has flown along the wear's body or the underwear.

(Power Source)

The power source 120 supplies electric power to the fans 140, which are described below. The power source 120 is attached to the garment body 110 or near the garment body 110 (e.g., the belt of trousers) by the power source holder 115. The power source 120 includes a built-in lithium-ion battery pack provided with a security circuit, for example, and a not-illustrated second connecting terminal to be connected to the fans 140 via the connection cable 130, which is described later.

[Connection Cable]

The connection cable 130 connects the power source 120 and the fans 140. The connection cable 130 is held on the inner surface of the garment body 110 by the cable holder 116. Via the connection cable 130, the power source 120 supplies the fans 140 with electric power necessary for operating the fans 140.

The detailed configurations of the power source holder 115, the cable holder 116, the power source 120, and the connection cable 130 are determined as desired.

[Fans]

The fans 140 are mounted on the garment body 110 by being inserted in the fan mount holes 113. The fans 140 are air introducers that are substantially flat and substantially round in a planar view and that introduces air into the space between the garment body 110 and the wearer's body through the fan mount holes 113, as shown in FIG. 1.

The fans 140 may be configured as desired as long as the fans 140 can be mounted on the garment body 110 by being inserted in the fan mount holes 113 and can introduce air inside the garment body 110. For example, each fan 140 has a fan body 141 and a ring-shaped mount ring 142 that fixes the fan body 141 to the garment body 110, as shown in FIG. 3.

[Fan Body]

The fan body 141 houses a propeller (not illustrated) and a motor (not illustrated) inside. As shown in FIG. 3, the fan body 141 includes: an air introducing part 1411 that constitutes the air introducing side when the fan 140 is in operation; an air sending part 1412 that constitutes the air sending side when the fan 140 is in operation; a tubular part 1413 that is a tubular connecting part between the air introducing part 1411 and the air sending part 1412; and a flange 1414 that protrudes from the air introducing part 1411-side end of the tubular part 1413 in a direction substantially perpendicular to the lateral surface of the tubular part 1413. The air introducing part 1411 has an opening that connects through to the air sending part 1412 and that forms an air channel to the inside of the fan-equipped garment 100. The tubular part 1413 is formed to be round, and the outer shape of the cross section of the tubular part 1413 is round when the tubular part 1413 is cut along a plane perpendicular to its central axis. The outer shape of the air introducing part 1411 is formed to be approximately equal to the diameter of the fan mount hole 113.

The outer shape of the fan 140 is not limited to a round shape but may be other shapes, such as a rectangular shape, for example.

The fan body 141 includes a first connection terminal 1415 at a predetermined position on the air sending part 1412-side. The first connection terminal 1415 is connected to the connection cable 130. The detailed configuration of the first connection terminal 1415 may be determined as desired as long as it is connectable to the connection cable 130 to receive electric power supplied by the power source 120.

(Mount Ring)

The mount ring 142 is a ring-shaped member for mounting the fan body 141 to the fan mount hole 113. The inner diameter of the mount ring 142 is equal to or slightly greater than the outer shape of the tubular part 1413. The mount ring 142 can be attached to the fan 140 by inserting the tubular part 1413 to the mount ring 142.

On the outer surface of the tubular part 1413 and the inner surface of the mount ring 142, engaging means (not illustrated) are formed. For example, a protrusion is formed on the inner surface side of the mount ring 142, and a recess that engages with the protrusion is formed on the outer surface side of the tubular part 1413.

Figure 3:
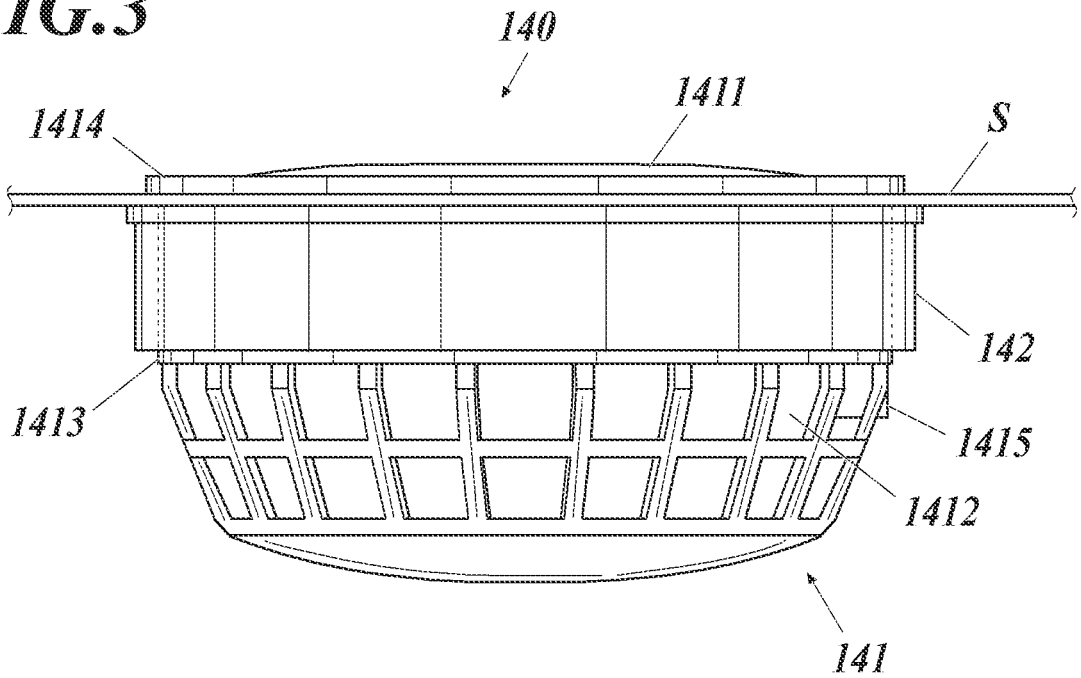
FIG. 3 is a schematic view of a fan mounted on the garment body of the fan-equipped garment.

To mount each fan 140 to the garment body 110, the air sending part 1412-side of the fan 140 is inserted from the outer surface of the garment body 110 into the fan mount hole 113 such that the flange 1414 is in contact with the portion around the fan mount hole 113 of the garment body 110, as shown in FIG. 3. Next, the mount ring 142 is fitted to the outside of the tubular part 1413 from the inside of the garment body 110. Thus, the flange 1414 and the mount ring 142 tuck in the portion around the fan mount hole 113 and the portion around the hole of an opening-hole stiffener of the sheet member S, which constitutes the garment body 110. In this state, the mount ring 142 is fixed to the fan body 141 by the engaging means.

Thus, the fan 140 is inserted in the fan mount hole 113 and fixed to the garment body 110. The method for mounting the fan 140 on the fan mount hole 113 is not limited to the above, and various known methods may be selected, such as the method of screwing a screw part formed on the tubular part 1413 of the fan 140 into the mount ring 142.

Advantageous Effects of Embodiment

According to known garments including a garment treated with titanium sputtering, the sunlight passes through the fabric and directly hits the skin or the underwear, thereby increasing the skin temperature. The fan-equipped garment 100 in this embodiment is formed of the sheet member S that includes: the front fabric 2 that has a high sunlight reflectivity or a high sunlight absorbency; and the heat insulation layer 3 that holds air, as shown in FIG. 2B. According to the fan-equipped garment 100, the front fabric 2 reflects or absorbs the sunlight, and air flows between the heat insulation layer 3 and the skin or the underwear. Thus, the heat is restrained from reaching the skin or the underwear. Even when the outside air temperature is higher than the skin temperature, the heat insulation layer 3 blocks the heat and restrains increase of the skin temperature. Thus, the fan-equipped garment 100 functions effectively.

The front fabric 2 of the fan-equipped garment 100 in this embodiment may be a mixed fabric of cotton and polyester. The heat insulation layer 3 is not worn away by abrasion with the underwear. Further, the fan-equipped garment 100 can be produced relatively inexpensively by providing only the heat insulation layer 3 to a conventional garment.

Second Embodiment

The fan-equipped garment 100A according to the second embodiment is described with reference to FIG. 4A to FIG. 5B. The parts that are the same as the parts of the fan-equipped garment 100 in the first embodiment are given the same reference numerals, and the description thereof is omitted.

Figure 4A:
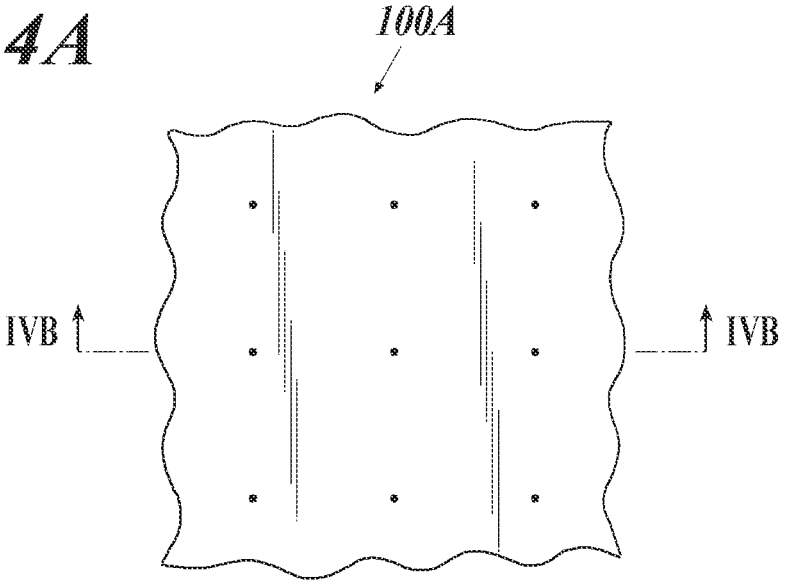
FIG. 4A is an enlarged view of the fan-equipped garment in a second embodiment.
Figure 4B:
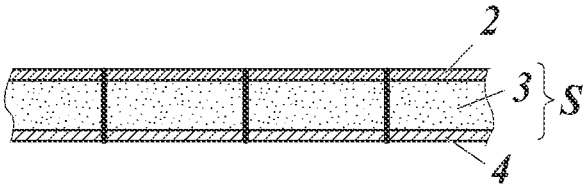
FIG. 4B is a cross section along the IVB-IVB part in FIG. 4A.

FIG. 4A is an enlarged front view of the fan-equipped garment 100A in the second embodiment. FIG. 4B is a cross section along the IVB-IVB in FIG. 4A.

As shown in FIG. 4B, the fan-equipped garment 100A in the second embodiment has a three-layer structure formed of the sheet member S including the front fabric 2, the heat insulation layer 3, and a back fabric 4 that is made of a material having a low sweat absorbency.

(Back Fabric)

The back fabric 4 constitutes the back surface side of the heat insulation layer 3 of the garment body 110. Preferably, the back fabric 4 is made of polyester that has a low sweat absorbency and a high sunlight absorbency. However, the back fabric 4 is not limited to polyester. A material that is used as a back fabric of a normal garment may be used as the back fabric 4, as desired.

Figure 5A:
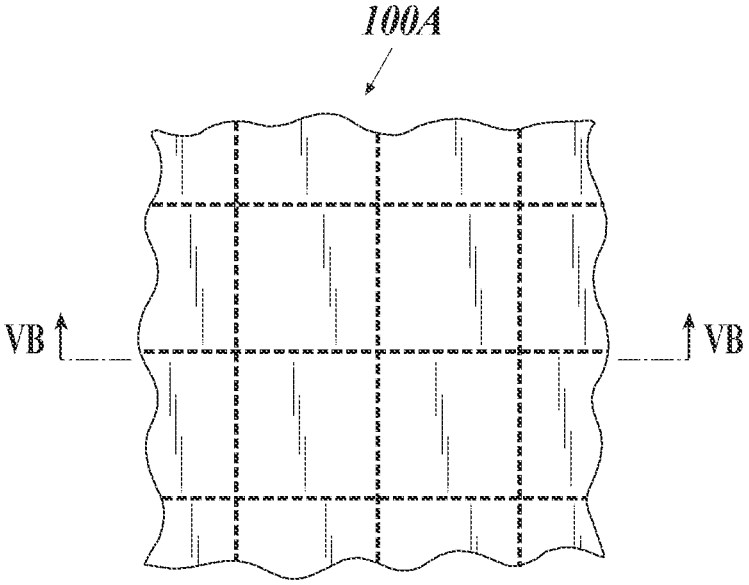
FIG. 5A is an enlarged view of the fan-equipped garment in a modification of the second embodiment.
Figure 5B:
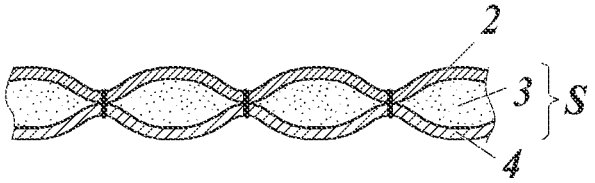
FIG. 5B is a cross section along the VB-VB part in FIG. 5A.

When the sheet member S and the garment body 110 has the above-described three layer structure and the heat insulation layer 3 consists of down, the heat insulation layer 3 as the intermediate layer needs to be prevented from moving. Preferably, as shown in FIG. 5A and FIG. 5B, the layers are sewn together with stitches in the crosswise direction or crosswise and lengthwise directions at an average interval of 10 centimeters, for example, such that the layers are combined, instead of simply sewn the layers on each other as shown in FIG. 4A and FIG. 4B. Along with that, preferably, the fan mount holes 113A and the fans 140A to be mounted on the fan-equipped garment 100A have a substantially rectangular shape.

Advantageous Effects of Embodiment

The fan-equipped garment 100A according to the second embodiment is a three-layer structure garment formed of the sheet member S that includes the front fabric 2, the heat insulation layer 3, and the back fabric 4 in the order from the front surface. Therefore, the sunlight that is not blocked by the front fabric 2 as the outermost layer is reflected or absorbed by the back fabric 4 as the inner layer.

Thus, the fan-equipped garment 100A can function effectively by further restraining the increase of skin temperature.

Third Embodiment

The fan-equipped garment 100B according to the third embodiment is described with reference to FIG. 6 to FIG. 10B. The parts that are the same as the parts of the fan-equipped garment 100 in the first embodiment are given the same reference numerals, and the description thereof is omitted.

The fan-equipped garment 100B according to the third embodiment includes fan mount hole covers 1131 and an air-discharge part adjuster(s) 1143.

[Fan Mount Hole Cover]

Figure 6:
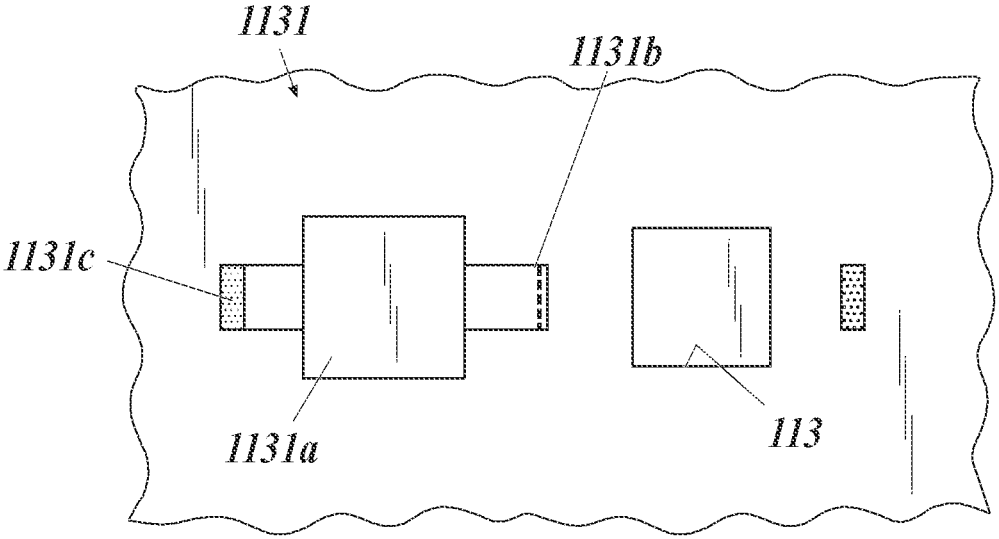
FIG. 6 is a front view of a fan mount hole when viewed from the inside of the garment body, the fan mount hole being provided with a fan mount hole cover according to a third embodiment.

The fan mount hole covers 1131 cover the fan mount holes 113 and prevent the outside air from flowing into the garment body 110B when the fans 140 are not mounted on the fan mount holes 113. As shown in FIG. 6 as an example, each of the fan mount hole covers 1131 includes a cover part 1131*a*, a fixed part 1131*b* that extends from the cover part 1131*a* toward one side, and an attaching-detaching part 1131*c* that extends toward the other side.

(Configuration of Fan Mount Hole Cover)

The cover part 1131*a* is made of a material having low air permeability (e.g., polyester). The cover part 1131*a* covers the fan mount hole 113. As with the garment body 110B, the cover part 1131*a* may have a multiple layer structure like the sheet member S.

The fixed part 1131*b* extends in one side from the cover part 1131*a*. The fixed part 1131*b* is fixed on the back surface side near the fan mount hole 113 to prevent the loss of the fan mount hole cover 1131.

The attaching-detaching part 1131*c* extends in the other side from the cover part 1131*a*. On the attaching-detaching part 1131*c*, a hook-and-loop fastener is stuck so as to be attachable and detachable from a hook-and-loop fastener stuck near the fan mount hole 113, for example. Thus, when the fan 140 is not mounted, the fan mount hole cover 1131 serves as a cover of the fan mount hole 113 by covering the fan mount hole 113 with the cover part 1131*a* on the inside of the garment body 110B.

When the heat insulation layer 3 is made of down as described above, it is preferable that the cover part 1131*a* be substantially rectangular.

The fan mount hole cover 1131 may not have the fixed part 1131*b* and may be a component independent from the garment body 110B. The garment body 110B may be provided with a storage bag in which the fan mount hole covers 1131 is stored.

[Air-Discharge Part Adjuster]

The air-discharge part adjuster 1143 is a structure for adjusting the air discharge pressure at the air-discharge part 114. The configuration of the air-discharge part adjuster 1143 differs depending on the position of the air-discharge part 114 on the garment body 110B.

(Collar Air-Discharge Part Adjuster)

Figure 7A:
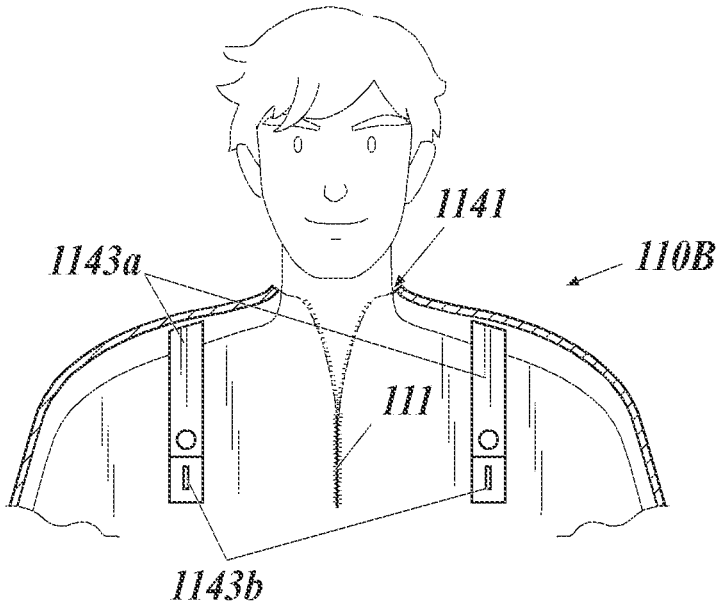
FIG. 7A is a front view of a collar air-discharge part of the fan-equipped garment provided with a collar air-discharge part adjuster in the third embodiment, wherein a collar adjuster belt is buttoned with an upper buttonhole.
Figure 7B:
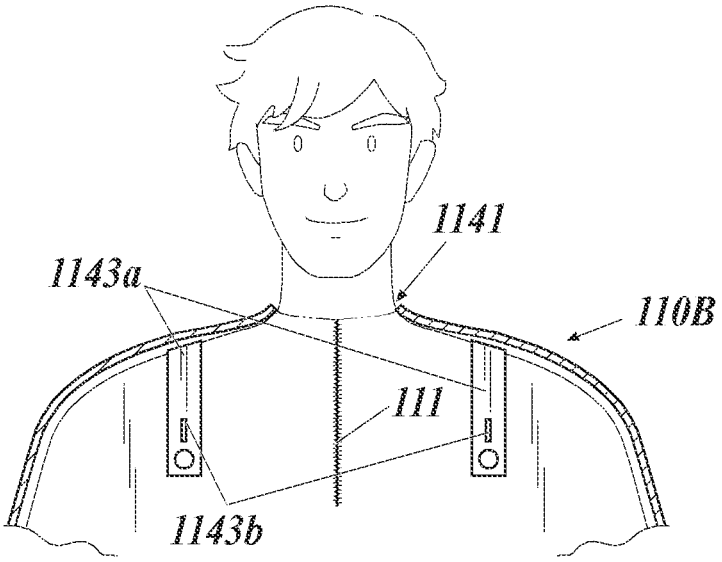
FIG. 7B is a front view of the collar air-discharge part of the fan-equipped garment provided with the collar air-discharge part adjuster in the third embodiment, wherein the collar adjuster belt is buttoned with a lower buttonhole.

When the collar air-discharge part 1141 is provided, the air-discharge part adjuster 1143 includes collar adjuster belts 1143*a* and buttonholes 1143*b* formed on the ends at the front part, as shown in FIG. 7A and FIG. 7B, for example. The collar adjuster belts 1143*a* have an appropriate length and are arranged at left and right of the garment and extend between the front part and the back part of the garment. One end of each of the collar adjuster belts 1143*a* is fixed to the back fabric 4B (the inner surface of the garment cloth of the garment body 110B) around the region corresponding to the shoulder blade below the collar. When the collar adjuster belts 1143*a* are buttoned with the upper buttonholes 1143*b* as shown in FIG. 7A, the upper part of the garment body 110B is lifted above the body, and the air discharge pressure at the collar air-discharge part 1141 weakens. When the collar adjuster belts 1143*a* are buttoned with the lower buttonholes 1143*b* as shown in FIG. 7B, the upper part of the garment body 110B closely fits to the body, and the air discharge pressure at the collar air-discharge part 1141 strengthens.

Although FIG. 7A and FIG. 7B show two buttonholes 1143*b* formed on the respective collar adjuster belts 1143*a*, the number of buttonholes 1143*b* is not limited thereto. There may be three or more buttonholes 1143*b* so that the air discharge pressure at the collar air-discharge part 1141 is adjustable by multiple levels.

Instead of the buttons, a hook-and-loop fastener structure may be used so that the air discharge pressure at the collar air-discharge part 1141 is continuously adjustable.

(Sleeve Air-Discharge Part Adjuster)

Figure 8A:
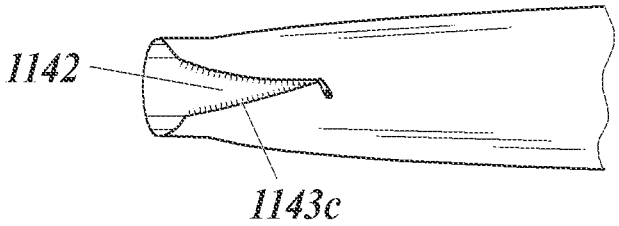
FIG. 8A is a front view of a sleeve of the fan-equipped garment in the third embodiment in which a sleeve air-discharge part adjuster is formed at the sleeve edge.
Figure 8B:
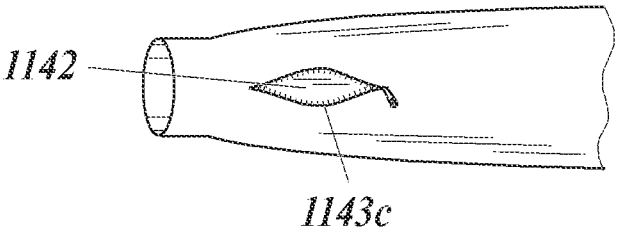
FIG. 8B is a front view of the sleeve of the fan-equipped garment in the third embodiment in which the sleeve air-discharge part adjuster is formed near the sleeve edge.

When the sleeve air-discharge parts 1142 are provided, the air-discharge part adjuster 1143 may be configured to adjust the diameter of the sleeve edge. For example, as shown in FIG. 8A and FIG. 8B, a linear fastener 1143*c* that is freely opened and closed is provided at a cut formed at the sleeve edge or near the sleeve edge in parallel with the arm part. By adjusting the degree of how much the opening opens, the air discharge pressure on the air flowing out through the sleeve can be adjusted.

Figure 8C:
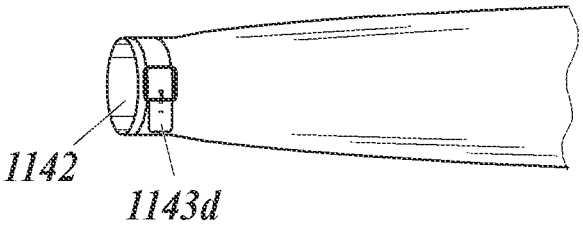
FIG. 8C is a front view of an example of the sleeve of the fan-equipped garment in the third embodiment in which the sleeve air-discharge part adjuster is provided.

Further, as shown in FIG. 8C as an example, a sleeve adjuster belt 1143*d* having a hook-and-loop fastener may be provided on the outside of the sleeve edge. The degree of how much the opening of the sleeve air-discharge part 1142 opens and the air discharge pressure on the air flowing out may be adjusted by adjusting the strength of fastening the sleeve adjuster belt 1143*d*.

Figure 8D:
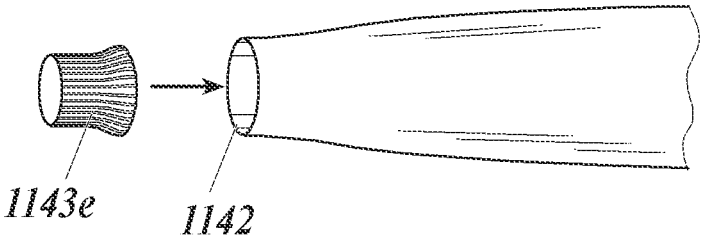
FIG. 8D is a front view of an example of the sleeve of the fan-equipped garment in the third embodiment in which the sleeve air-discharge part adjuster is provided.

Further, as shown in FIG. 8D as an example, a rib part 1143*e* that is an independent cylindrical knitted part may be provided. By attaching and detaching the rib part 1143*e* on the sleeve edge with a hook-and-loop fastener, the air discharge pressure on the air flowing out from the sleeve may be adjusted.

Figure 8E:
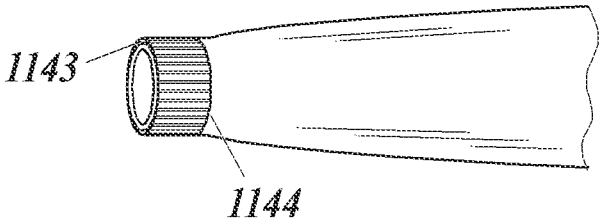
FIG. 8E is a front view of an example of the sleeve of the fan-equipped garment in the third embodiment in which the sleeve air-discharge part adjuster is provided.

When the rib part 1143*e* is provided, a plastic cylinder 1144 that is covered with cloth and that serves as a sealing part of the sleeve air-discharge part 1142 may be fitted to the rib part 1143*e* so as to completely seal the sleeve air-discharge part 1142, as shown in FIG. 8E.

When the sleeve air-discharge part 1142 is provided, it is preferable that the circumference length of the sleeve air-discharge part 1142 be adjustable to 130% or greater of the minimum circumference length so that a more sufficient amount of air can be discharged.

(Air-Discharge Adjuster for Hood)

Figure 9:
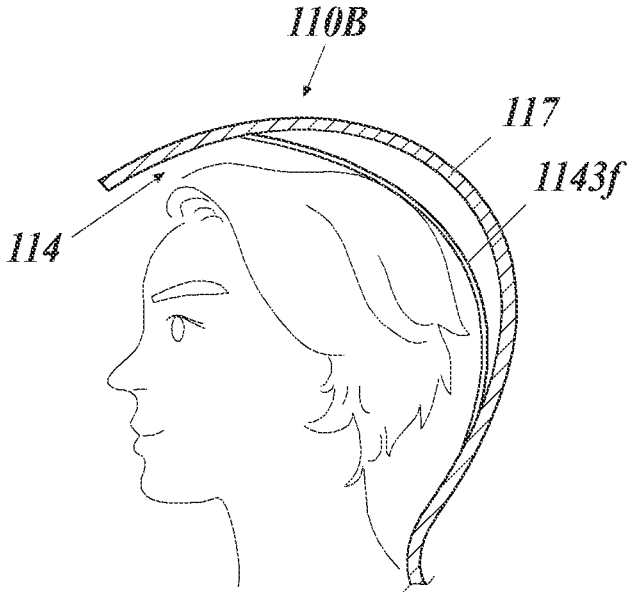
FIG. 9 is a sectional side view of the fan-equipped garment in which an air-discharge part adjuster is attached to a hood.

As shown in FIG. 9, when a hood 117 for covering the head and the neck of the wearer is provided at the part corresponding to the collar of the garment body 110B, a band 1143*f* may be provided on the back fabric of the hood 117. The band 1143*f* is wide and made of mesh, and is shorter than the length of the inside of the head part of the hood 117.

With such a belt 1143*f*, the hood 117 is lifted up, and a space is formed between the back fabric of the hood 117 and the parietal region of the head. Accordingly, the air discharge pressure weakens.

(Air-Discharge Adjuster for Shoulder)

Figure 10A:
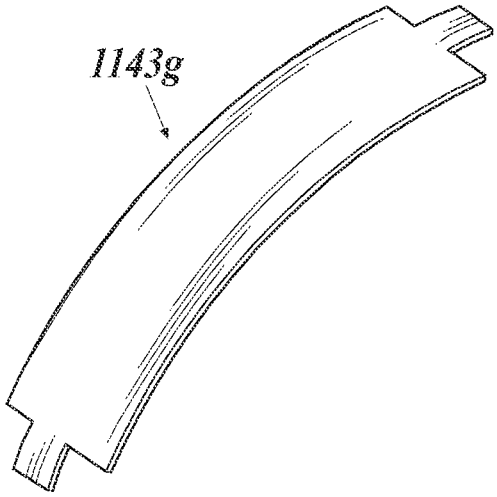
FIG. 10A is a perspective front view of an air-discharge part adjuster to be attached to the shoulder part in the third embodiment.

As shown in FIG. 10A, a shoulder lifting plate(s) 1143*g* that has protrusions on both ends and that gently curves may be provided. On the left and right of the front part and the back part of the garment body 110B, insertion parts (not illustrated) in which the protrusions can be inserted may be provided.

Figure 10B:
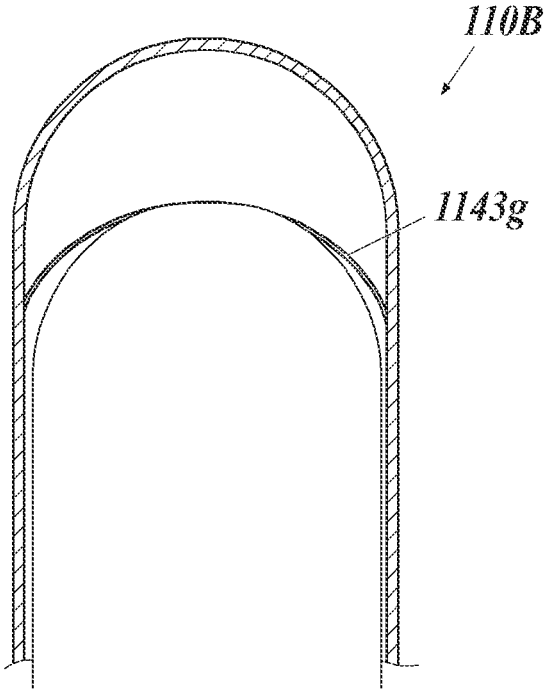
FIG. 10B is a sectional side view of the fan-equipped garment to which the air-discharge part adjuster shown in FIG. 10A is attached.

As shown in FIG. 10B, when the protrusions of the shoulder lifting plate 1143*g* are inserted in the insertion parts, the shoulder lifting plate 1143*g* is connected to the garment body 110B. When the wearer wears the garment body 110B, the shoulder of the wearer abuts the shoulder lifting plate 1143*g*, and the upper part of the garment body 110B is lifted from the body. Accordingly, a space is formed and the air discharge pressure at the collar air-discharge part 1141 weakens.

Advantageous Effects of Embodiment

According to a known garment body of a fan-equipped garment, the outside air enters inside the garment body through the air discharge part(s). On days the outside air temperature is low (e.g., in winter), the fan-equipped garment is not suitable because the outside air having a temperature lower than the skin temperature flows in and decreases the skin temperature.

On the other hand, the fan-equipped garment 100B in this embodiment includes the fan mount hole covers 1131 that cover the fan mount holes 113; and the air-discharge part adjuster(s) 1143 for adjusting the degree of how much the opening of the air-discharge part 114 opens and the air discharge pressure at the air-discharge part 114. Such a fan-equipped garment 100B can prevent the outside air from flowing into the fan-equipped garment 100B. Therefore, even on a day the outside air temperature is low, the wearer can comfortably wear the fan-equipped garment 100B.

Fourth Embodiment

The fan-equipped garment 100C according to the fourth embodiment is described with reference to FIG. 11A to FIG. 11C. The parts that are the same as the parts of the fan-equipped garment 100 in the first embodiment are given the same reference numerals, and the description thereof is omitted.

The garment body 110C according to the fourth embodiment is a coat type that covers the trunk, the arms, and part of the legs of the wearer. Since the garment body 110 in the first embodiment is a blouson type that covers the trunk and the arms of the wearer, the air-leakage preventer 112 can be provided at the lower part of the garment body 110. The garment body 110C in the fourth embodiment, on the other hand, is long enough to cover part of the legs of the wearer. Therefore, when the air-leakage preventer 112 is provided at the hem, the garment body 110C does not look so nice, and the wearer may not move easily.

Figure 11A:
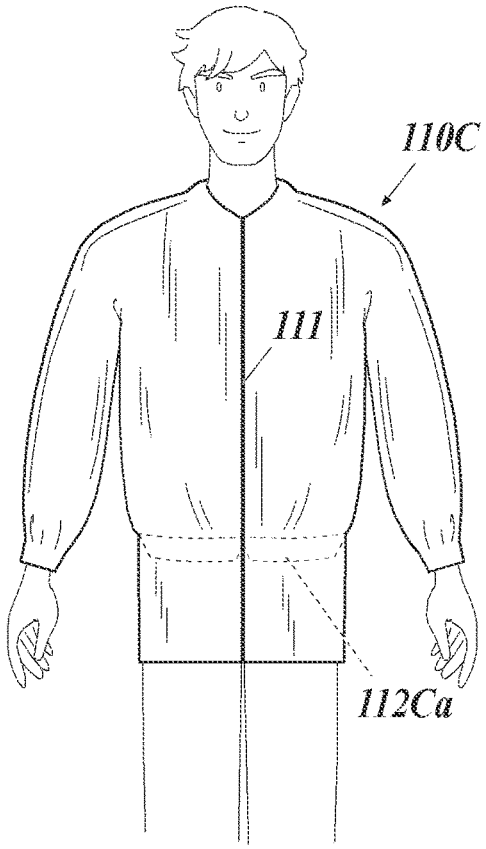
FIG. 11A is a front view of an example of the fan-equipped garment in the fourth embodiment in which an air-leakage preventer is formed.
Figure 11B:
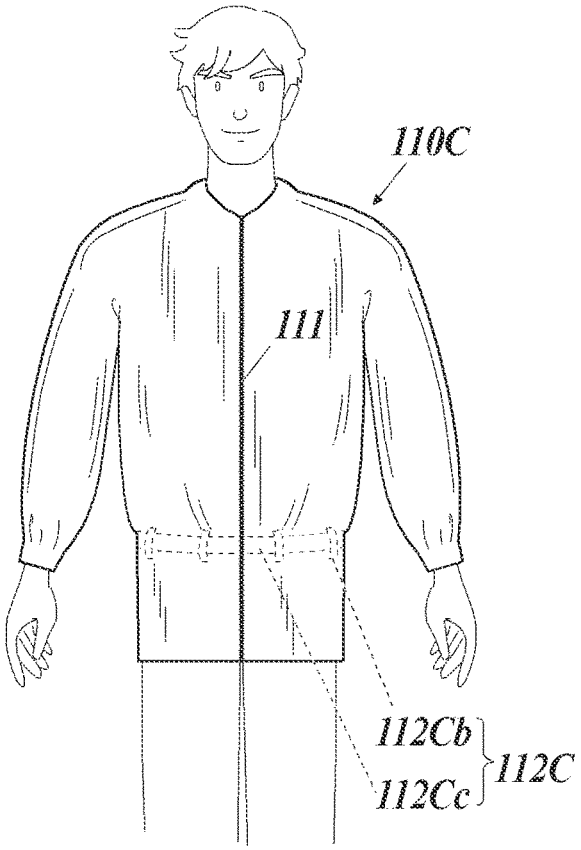
FIG. 11B is a front view of an example of the fan-equipped garment in the fourth embodiment in which the air-leakage preventer is formed.
Figure 11C:
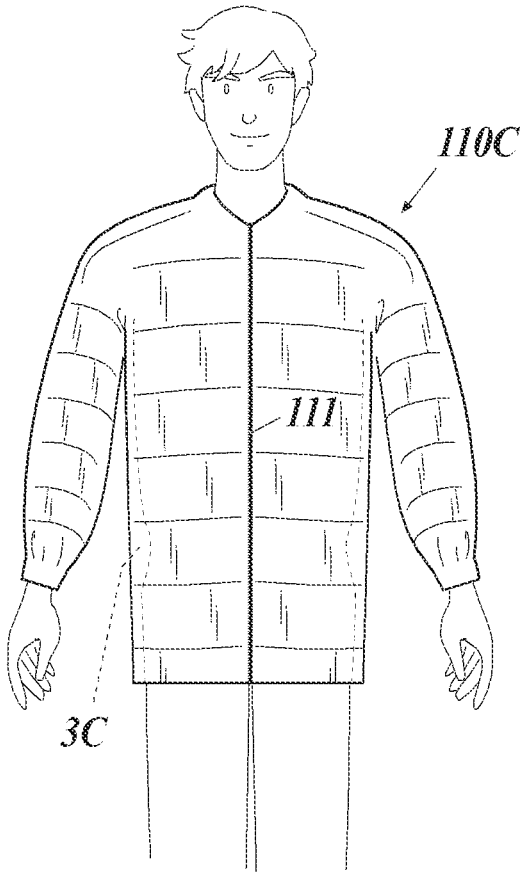
FIG. 11C is a front view of an example of the fan-equipped garment in the fourth embodiment in which the air-leakage preventer is formed.

To deal with this, the garment body 110C according to the fourth embodiment is provided with an inner hem 112Ca as the air-leakage preventer 112C at the part corresponding to the waist of the wearer, as shown in FIG. 11A.

Thus, as with the garment bodies 110 to 110B, the garment body 110C can prevent the outside air from entering through the bottom of the air-leakage preventer 112C, while retaining the external appearance and the easiness of movement of the coat-type garment body 110C. Further, a flow channel is formed such that the outside air taken in by the fans 140 is discharged through the air-discharge part 114, so that the cooling effect is enhanced for the upper half of the wearer's body.

The air-leakage preventer 112C for the coat-type garment body 110C is not limited to the inner hem 112Ca. As shown in FIG. 11B, multiple ring-shaped insertion parts 112Cb may be provided on the back surface side of the garment body 110C, and a tubular body 112Cc made of a low-density sponge pipe or the like may be inserted, so that no space is present between the garment body 110C and the waist of the wearer.

Herein, the insertion parts 112Cb may not be provided on the inside, and the tubular body 112Cc may be directly sewn on the garment body 110C.

The air-leakage preventer 112C may be formed by changing the shape of the garment body 110C. For example, as shown in FIG. 11C, the front fabric 2, the heat insulation layer 3C, and the back fabric 4 may be joined together with stitches only in the sidewise direction, and the heat insulation layer 3 may be thick around the waist so that the space between the waist and the back fabric 4 is narrowed.

Other Modifications

Although the color of the garment body 110 is not limited to a specific color in the above embodiments, it is preferable that the front fabric 2 have a light color and the back fabric 4 have a deep color. The light-colored front fabric 2 can have an increased sunlight reflectivity, and the deep-colored back fabric 4 can have an increased sunlight absorbency.

As for the material of the garment body 110, it is preferable that the front fabric 2 be made of a material having a high reflectivity and that the back fabric 4 be made of a material having a high absorbency in consideration of the wavelength distribution of the sunlight. Further, although the sheet member S has the front fabric 2 and the heat insulation layer 3 or has the front fabric 2, the heat insulation layer 3, and the back fabric 4, the sheet member S is not limited to these examples. The sheet member S may have more layers.

Naturally, detailed configurations and so forth of the above embodiments can be appropriately modified.

INDUSTRIAL APPLICABILITY

The present invention is applicable to a garment body of a fan-equipped garment and the fan-equipped garment, the garment body having high heat-insulation effects and being able to block the sunlight and thereby functioning effectively.

REFERENCE SIGNS LIST

2 Front fabric
3, 3C Heat insulation layer
4, 4B Back fabric
100, 100A, 100B, 100C Fan-equipped garment
110, 110A, 110B, 110C Garment body
112, 112C Air-leakage preventer
113, 113A Fan mount hole
1131 Fan mount hole cover
1141 Collar air-discharge part
1142 Sleeve air-discharge part
1143 Air-discharge part adjuster
1143*e* Rib part
1144 Cylinder (sealing part)
117 Hood
120 Power source (power source)
140, 140A Fan (air introducer)

The invention claimed is:

1. A garment body of a fan-equipped garment, comprising:
- a fan mount hole for mounting a fan;
- a front fabric made of a material having no breathability or having a certain level of breathability to be inflated with air introduced by the fan;
- a heat insulation layer disposed on a back side of the front fabric and made of a material that is configured to hold air; and
- a back fabric disposed on a back side of the heat insulation layer, wherein:
- the front fabric, the heat insulation layer, and the back fabric are combined with stitches,
- the material from which the front fabric is made has a higher sunlight reflectivity than the back fabric, and
- when the garment body is worn by a wearer and air is introduced into the garment body by the fan, the air introduced inside the garment body flows between the back fabric and a body of the wearer such that sweat drained from the body of the wearer evaporates and the body is cooled by evaporation heat generated in evaporation of the sweat.

2. The garment body of the fan-equipped garment according to claim 1, further comprising:
- a collar air-discharge part that is configured to be positioned between a neck of a wearer and an end of a collar of the garment body when the garment body is worn by the wearer, and that is configured to discharge the air that is introduced inside the garment body through the fan mount hole; and
- a collar air-discharge part adjuster that is configured to adjust an air discharge pressure at the collar air-discharge part.

3. The garment body of the fan-equipped garment according to claim 1, wherein:
- the garment body has a long sleeve, and
- the garment body further comprises:
  - a sleeve air-discharge part that is configured to be positioned between an arm of a wearer and an end of the sleeve when the garment body is worn by the wearer, and that is configured to discharge the air that is introduced inside the garment body through the fan mount hole; and
  - a sleeve air-discharge part adjuster that is configured to adjust an air discharge pressure at the sleeve air-discharge part.

4. The garment body of the fan-equipped garment according to claim 3, wherein the sleeve air-discharge part adjuster comprises a rib part and is freely attachable to and detachable from a part of the sleeve that is configured to face a wrist.

5. The garment body of the fan-equipped garment according to claim 3, further comprising a sealing part that is configured to seal the sleeve air-discharge part.

6. The garment body of the fan-equipped garment according to claim 3, wherein the sleeve air-discharge part adjuster is configured to adjust a circumference length of the sleeve air-discharge part to 130% or greater of a minimum circumference length.

7. The garment body of the fan-equipped garment according to claim 1, further comprising a hood that is configured to cover a neck and a head of the wearer,
- wherein an air-discharge part adjuster for adjusting an air discharge pressure between the head and the hood is attachable to an inner surface of the hood.

8. The garment body of the fan-equipped garment according to claim 1, wherein a fan mount hole cover for covering the fan mount hole is housed inside the garment body.

9. The garment body of the fan-equipped garment according to claim 1, wherein:
- the garment body is a coat type configured to cover a trunk, arms, and part of legs of a wearer, and
- an air-leakage preventer is formed at a waist part inside the garment body.

10. The garment body of the fan-equipped garment according to claim 1, wherein the back fabric is made of a material that has a higher sunlight absorbency than the front fabric and the heat insulation layer.

11. The garment body of the fan-equipped garment according to claim 1, wherein a color of the back fabric is darker than a color of the front fabric.

12. The garment body of the fan-equipped garment according to claim 1, wherein the fan mount hole has a rectangular shape.

13. The garment body of the fan-equipped garment according to claim 12, wherein:
- the stitches are formed at least in a crosswise direction, and two opposite sides of the rectangular fan mount hole are formed i to be parallel to the stitches in the crosswise direction.

14. A fan-equipped garment comprising:

the garment body of the fan-equipped garment according to claim 1, an air introducer configured to introduce air inside the garment body of the fan-equipped garment, and a power source configured to supply electric power to the air introducer.

* * * * *